United States Patent [19]

Janvrin et al.

[11] 4,364,621

[45] Dec. 21, 1982

[54] ELECTRICAL CONNECTOR

[75] Inventors: Robert B. Janvrin, Climax; Charles J. Bowden, Battle Creek, both of Mich.

[73] Assignee: General Signal Corp., Stamford, Conn.

[21] Appl. No.: 125,602

[22] Filed: Feb. 28, 1980

[51] Int. Cl.[3] ..... H01R 11/00

[52] U.S. Cl. ..... 339/59 M

[58] Field of Search ..... 339/59 M, 61 R, 61 C, 339/61 L, 61 M, 136 R, 136 C, 136 M, 137, 139 R, 139 C, 140 R, 140 C, 140 S, 217 S

[56] References Cited

U.S. PATENT DOCUMENTS

| | | | |
|---|---|---|---|
| 2,563,712 | 8/1951 | Frei et al. | 339/60 M |
| 2,593,182 | 4/1952 | Quackenbush | 339/136 M |
| 3,101,229 | 8/1963 | Yopp | 339/59 M |
| 3,181,102 | 4/1965 | Fehr, Jr. | 339/59 M X |
| 3,383,637 | 5/1968 | De Lano | 339/14 R |
| 3,631,375 | 12/1971 | Bridle | 339/59 M |
| 3,747,047 | 7/1973 | Carter et al. | 339/59 M X |
| 3,951,514 | 4/1976 | Medina, Jr. | 339/64 M X |
| 4,017,141 | 4/1977 | Bury et al. | 339/196 M X |

*Primary Examiner*—Joseph H. McGlynn
*Assistant Examiner*—Frank H. McKenzie, Jr.
*Attorney, Agent, or Firm*—Thomas R. FitzGerald; Jeffrey S. Mednick

[57] ABSTRACT

An electrical connector has a body of molded insulating material for fixedly holding a plurality of electrical conductors in the body. The connector body has openings with axial and radial passageways provided for axially or radially inserting or removing the conductors. A plurality of hinges are integral with the body and adjacent each opening for enlarging the adjacent opening in order to easily insert or remove conductors. The body is resiliently held in place by means of a seal disposed against an end wall of the body. Two or more elongated tabs are disposed opposite from one another and integral with an outer wall of the body for manipulating the outer wall to easily insert or remove the electrical connector from an electrical connector cavity.

9 Claims, 9 Drawing Figures

Fig. 5A
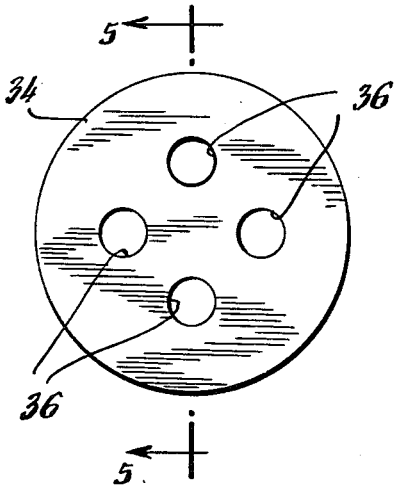
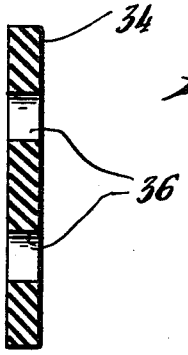
Fig. 5.
Fig. 6.
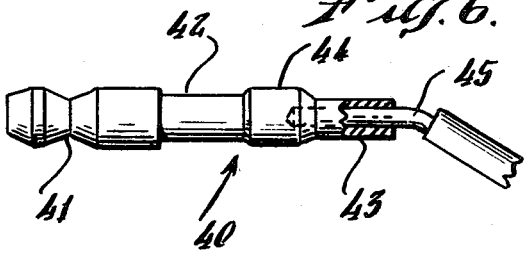
Fig. 7.
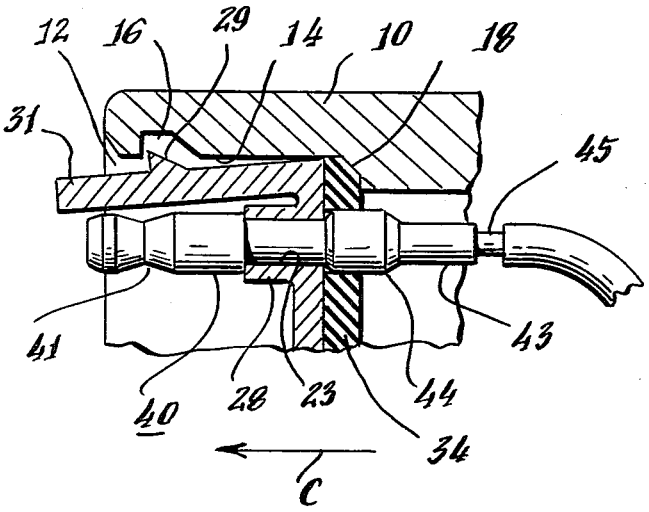
Fig. 8.
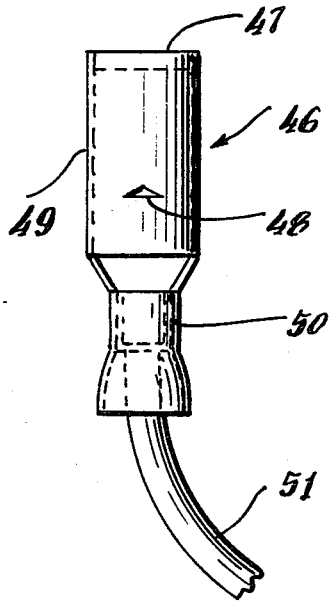

ELECTRICAL CONNECTOR

BACKGROUND OF THE INVENTION

This invention relates to electrical connectors having insertable and removable contacts, and, in particular, to electrical connectors adapted for connecting control valves or other devices to the wiring harness of mobile equipment.

Electrical connectors for holding pin-type electrical conductor terminals have gained wide acceptance in many industrial areas. Such connectors generally include a molded body with contact holding cavities or collars which hold the pin-type electrical terminal or receptacle. Examples of such connectors may be found in U.S. Pat. Nos. 3,101,229; 3,383,637; 3,747,047; and 4,017,141. The latter patent discloses a device having a lock structure with a hinged door which snaps into place over a projecting portion of a terminal pin or receptacle in order to hold the receptacle in position.

Among the numerous varieties of available electrical connectors, some connectors have bodies which are threaded into place U.S. Pat. Nos. 3,631,375, and 2,563,712 another that provides bidirectional passages for the insertion or removal of terminals (U.S. Pat. Nos. 4,082,398 and 2,593,182).

In the field of mobile hydraulic equipment, it is desirable to have an electrical connector which seals electrically operated components from the moisture and dust in which the equipment operates, provides for two, three or four point terminal connections, is simple to assemble, and can be easily disassembled for the service of the connector including replacement of the terminals or conversion of the connector from a two point connector to a three or a four point connector or vice versa. No known connector meets all of the above requirements. To the contrary, many available connectors have the pins permanently molded into the body so that any mismolding causes the scrap of expensive pins. Such permanent type pins cannot be disassembled for service. Moreover, the shrinking of the molded body from around the pins requires that an additional epoxy or sealer be applied at the pin-to-body connection.

SUMMARY

It is an object of this invention to provide a new, useful, and unobvious electrical connector for use in conjunction with mobile hydraulic equipment.

It is another object of the invention to provide an electrical connector in which the electrical terminals can be easily assembled or disassembled.

It is a further object of this invention to provide an electrical connector which easily snaps into place in the connector cavity of a hydraulic valve or other equipment.

It is still another object of this invention to provide an electrical conductor that can be easily changed to hold either 2, 3, or 4 electrical terminals.

Still another object of this invention is to provide an electrical connector with an improved seal.

In summary, the invention has a body of molded insulating material adapted for receiving and supporting and fixedly holding a plurality of electrical terminals in the molded body. The body of the connector has openings therein and each opening comprises an axial passageway along the length of the body and a radial passageway extending outwardly from the axial passageway so that a conductor can be either axially or radially inserted in or removed from the openings in the body of the connector. In order to assist the insertion or removal of the terminals, each opening is provided with a hinge operatively joined to the body adjacent the opening. The hinge is operable for enlarging the adjacent opening in order to facilitate the assembly or disassembly of terminals within the openings provided therefor. In the preferred embodiment, the body of the connector is formed from flexible, resilient material and the hinges are integral with the body and are operable to bend the body at the integral hinges in order to enlargen the terminal openings.

The body or terminal holder of the electrical connector of the invention has a snap-in feature which allows the body to be easily inserted or removed from a connector cavity. It is contemplated that such a connector cavity have an inner wall with a recessed portion for accommodating a projecting portion of the body. The body has an outer wall with raised or projecting portions for engaging and fitting into the recessed portion of the connector cavity inner wall in order to firmly hold the body in place in the cavity. The body has an end wall with integral collars for accommodating and fixedly holding an inserted electrical terminal. The opening in the collar corresponds to the axial opening in the body of the connector.

The outer wall of the body has at least two elongated tab portions integral with the outer wall and aligned with the projecting portions thereof. When properly inserted into a connector cavity, the tab portions project outside of the cavity for an operator to easily grasp between two fingers. In this manner, an operator may manipulate the tabs to press them towards each other and thereby release the projection portions of the outer wall from the recessed portions of the inner cavity wall in order to easily withdraw the connector from the cavity.

Adjacent the end wall of the body is a resilient seal which engages the outer surface of an electrical terminal that is inserted into the body of the connector. The invention contemplates using a terminal having a solid cross-sectional area in contrast to most of those currently used which are hollow inside. In this manner, the invention provides for a better, continuous seal once the body is inserted into the cavity. In addition, the resilient seal urges the projecting portion of the outer wall into the recessed portion of the inner cavity wall thereby providing the positive snap-in fit of the connector in the cavity.

Having thus summarized the features of the preferred embodiment of the invention, further reference may be had to the following detailed description and the accompanying drawings wherein the best mode contemplated for carrying out this invention is described in exact terms in order to enable any person skilled in the electrical connector art to make and use the subject invention.

DRAWINGS

FIG. 5 is a cross-sectional view of the seal of the invention;

FIG. 5A is a plan view of the same seal;

FIG. 6 is a longitudinal view of the electrical terminal of the invention;

FIG. 7 is a partial cross-sectional assembly view of the invention in a connector cavity;

FIG. 8 is a longitudinal view of a receptacle terminal which is insertable over the pin-type terminal shown in FIG. 6.

DETAILED DESCRIPTION

Figure 1:
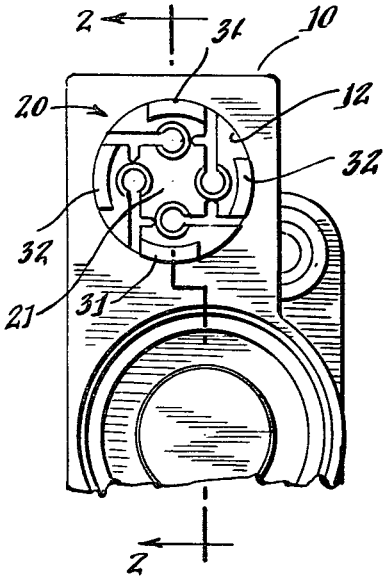
FIG. 1 is an elevation view of a body or terminal holder assembled in a connector cavity of a control valve for a piece of mobile equipment.
Figure 2:
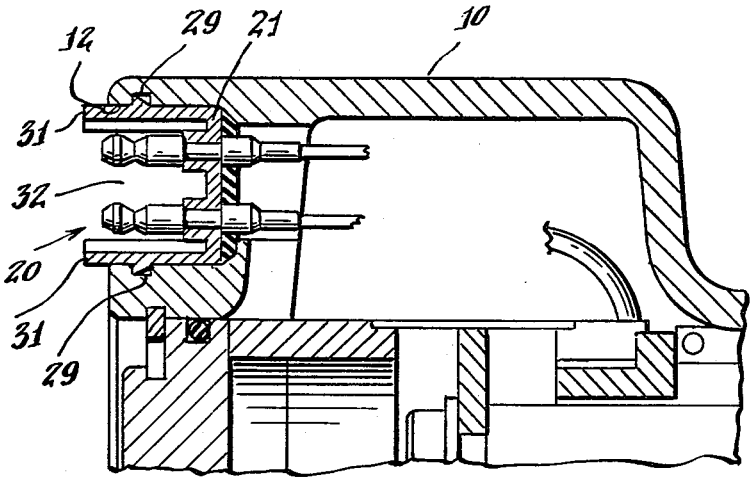
FIG. 2 is a cross-sectional view taken along the line 2—2 of FIG. 1.

With reference to FIG. 1, the electrical connector 20 of the invention is shown with a body or terminal holder 21 mounted in a cavity 12 of the connector. The connector 20 may include a solenoid that is attached mechanically to a valve (not shown) in order to operate said valve in an manner well known in the art. Turning to FIG. 2, there is shown a cross-sectional view of how body 21 fits snugly inside the cavity 12.

Figure 3:
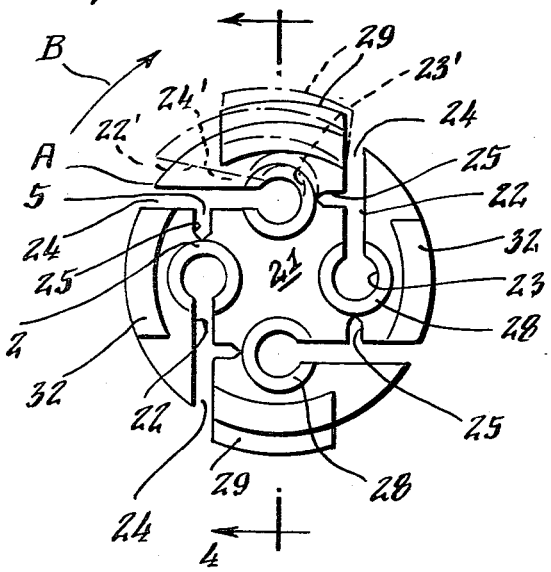
FIG. 3 is an enlarged elevational view of the invention showing an enlarged opening therein.
Figure 4:
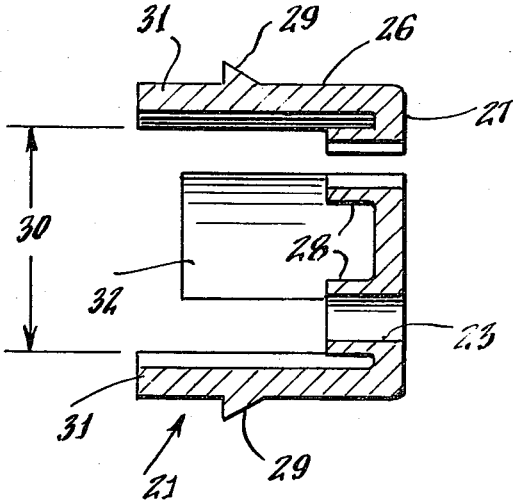
FIG. 4 is a cross-sectional view taken along the line 4—4 of FIG. 3.

With reference to FIGS. 3 and 4, there 20 is shown a generally cylindrically shaped resilient molded body 21. There are four openings 22 in the body 21. Each opening includes an axial passageway 23 as well as a radial passageway 24 extending from the axial passageway 23 to the outside of the outer wall 26 of body 21. A pair of saw-toothed projections 29 are integrally mounted on the outer wall 26 of body 21. Outer wall 26 is comprised of four tab sections, including two elongated sections 31 and two shorter tab-like projections 32. The saw-toothed-like projections 29 are aligned with the elongated tab projections 31.

At one end of connector body 21, there is an opening 30 for receiving one or more receptacles 46 (FIG. 8). Integral with the outer end of electrical connector body 21 is an end wall 27. Molded into the end wall 27 are four collars 28 which fixedly hold and support an electrical terminal 40, such as the one illustrated in FIG. 6.

Turning to FIG. 6, there is shown a typical electrical terminal 40 which may be used with the subject invention. Terminal 40 is a pin-like terminal consisting of an elongated cylindrical body having a v-notch 41 at one end thereof and a reduced diameter groove portion 42 spaced from the v groove 41. The groove portion 42 is adapted to fit snugly inside a collar 28 of the electrical connector 21. A sealing portion 44 is adjacent the groove 42. The sealing portion 44 is adapted to be snugly engaged by a resilient seal 34 which may have any number of openings 36 in order to seal a corresponding number of terminals 40. At the end of terminal 40 is a crimped portion 43 which may be tightly fastened in a conventional manner to an electrical conductor or wire 45.

The hinge feature of the invention is best shown in FIG. 3. There, four hinges 25 are shown to be integral with the collars 28 and end wall 27 of the connector body 21. The hinge section 25 is integral with end wall 27, adjacent the collar 28 and in line with the radial passageway 24 but spaced therefrom by the thickness of collar 28. The hinge 25 more particularly consists of a bendable portion 2 of the collar 28 and an adjacent void 5 in end wall 27. In operation, an operator may grasp the end wall at a point A and bend the end wall in the direction indicated by arrow B in order to enlargen the opening 22 to form a larger opening 22′ so that the conductor 40 may be easily inserted into the collar 28 or removed therefrom through the enlarged axial passageway 23′ and radial passageway 24′. Accordingly, the hinge 25 facilitates the insertion or removal of a terminal 40 in either the radial or the axial direction.

Once the desired number of terminals 40 have been inserted into their respective collars 28, the connector body may be fitted into the cavity 12 provided therefor. When the body 21 is so fitted, the seal 34 cooperates with the connector body 21 in order to bias the saw-toothed projecting portions 29 into fixedly engaging recessed portions 16 of the inner wall 14 of valve body 10. The latter is best shown in FIG. 7. The housing 10 has a chamfered or reduced diameter portion 18 which forms a seat for the seal 34 when the seal and connector body 21 are inserted into cavity 12. The seal 34 is made of resilient material, hence the seal acts upon the end wall 27 of connector body 21 in order to bias the connector body 21 in a direction indicated by arrow C. Accordingly, an operator pushes upon the elongated tab portions 31 in order to urge the connector against the seal at chamfer 18 until the saw-toothed projecting portions 29 are aligned with the recessed portions 16 of inner wall 14. At that point, the saw-toothed portions will snap into their respective recesses and the connector 20 will be snugly fitted and held into place by virtue of the resiliency of the seal 34 and the engagement of saw-tooth projections 29 with recessed portions 16. In order to remove the connector body 21 from its cavity 12, an operator manipulates the elongated tabs 31 to press them towards one another and thereby withdraw the projecting portions 29 from their recesses 16 and thus freely withdraw the entire connector body 21 from cavity 12.

Another feature of the invention is a positive seating arrangement whereby the connector body 21 will not receive any receptacles 46 inserted through entrance 30 unless and until the connector 20 is properly fitted inside cavity 12. This feature is a result of the relatively close tolerances between the inserted terminal 40 and the tabs 31, 32. With reference to FIG. 8, there is shown a typical receptacle 46 including a crimped cylindrical terminal receptacle 47 having a v-shaped protrusion 48 for engaging the v-notch 41 in terminal 40 in order to establish an electrical connection between terminal 40 and receptacle 46. Surrounding the cylindrical terminal 47 is insulating material 49. At the end of the cylindrical terminal 47 there is a crimped portion 50 for fixing the receptacle 46 to a wire 51 in a conventional manner.

Due to the relatively close tolerances between the tabs 31, 32 of the connector body and the terminals 40, it is impossible for an operator to insert a receptacle 46 over the terminal 40 unless and until the entire connector body 21 is properly seated within cavity 12. This is so because the protruding portions 29 will engage the inner wall 14 of the cavity thereby closing off the space between the elongated tab 31 and the conductor 40 through which the insulating portion 49 of receptacle 46 must pass in order for the receptacle 46 to be mounted on the terminal 40.

Still another feature of the invention is an improved rear sealing surface. This improved sealing surface is formed by the combination of the resilient seal 34, together with terminal 40 which has a solid cross-sectional area in its sealing portion 44. Accordingly, when the connector body 21 is properly assembled, one end of the seal 34 is seated against the chamfered portion 18 of housing 10. Then, the openings 36 tightly seal around the sealing portions 44 of the terminals 40. Unlike other, rolled-type terminals, the terminal 40 of the invention has a solid cross-sectional area thereby preventing moisture or dirt from passing through the middle thereof and effecting the connection between the crimped portion 43 and wire 45.

Still a further feature of the invention is that a single connector body 21 may be used for applications involving 2, 3, or 4 terminals 40. The connector 20 is easily adapted from one number of terminals to the other by simply changing the resilient seal 34 to one having the proper number of holes for the altered connection. Hence, a user need only stock one connector body 21 for 2, 3, or 4 terminal-type connections. The different terminal-type connections can be made by using the desired number of terminals together with a relatively inexpensive seal 34 having a number of openings 36 corresponding to the number of terminals 40.

Having thus described the preferred embodiment and best mode of carrying out the invention, it is understood that those skilled in the art will be able to make modifications and additions thereto without departing from the spirit and scope of the invention as defined in the appended claims.

What is claimed is:

1. An apparatus for holding a plurality of electrical terminals comprising:

a body of molded insulating material adapted for receiving, supporting and fixedly holding a plurality of terminals in said body;

a plurality of openings in said body, each opening having (a) an axial passageway having a cross-sectional area substantially the same as the cross-sectional area of a terminal held therein and extending along the length of the body, each axial passageway having a collar mounted therein for fixedly holding a terminal inserted in the axial passageway, and (b) a radial passageway normally substantially smaller in cross-sectional than the axial passageway and extending outwardly from the axial passageway so that a terminal can be axially and radially inserted in and removed from the body of the connector; and a plurality of hinges operatively joined to the body, each hinge being adjacent each axial collar and operable for enlarging the cross-sectional areas of the radial passageway and the axial collar enough to accommodate the passage of a terminal having a cross-sectional area substantially the same as the cross-sectional area of the axial passageway in order to facilitate the insertion or removal of terminals within the axial collars provided therefor.

2. The invention of claim 1 wherein the body of the connector is formed from flexible, resilient material and the hinges are integral with the body and are operable to bend the body at the integral hinges in order to enlargen the openings for inserting or removing the terminals.

3. The invention of claim 1 wherein said body includes an entrance at one end, a wall at the other end, a plurality of axial collars integral with said wall, each axial collar for holding a terminal fixedly in place, an axial passageway extending outwardly through said wall, said integral hinges including a bendable portion of said collars disposed opposite said radial passageways and a void in said wall adjacent said bendable collar portion.

4. The apparatus of claim 1 wherein the body of molded insulating material further comprises a plurality of projecting portions on an outer surface of said body suitable for engaging and fitting into recessed portions of a connector cavity adapted to receive such a body, and a plurality of elongated tab portions, integral with said body and aligned with said projecting portions thereof and long enough to extend beyond such a connector cavity so that when the projecting portions are fitted into recessed portions of an electrical connector, the body is removable from the electrical connector by manipulating the elongated tabs to move toward each other, thereby withdrawing said projecting portions from the recessed portions of such electrical connector cavity.

5. The apparatus of claim 4 wherein the body of molded flexible insulating material has two integral elongated tab portions in two corresponding, aligned projecting portions.

6. An electrical connector in combination comprising:

a body having a cavity with an inner cavity wall for snugly fitting against an outer connector wall, the inner cavity wall having recessed portions therein for accommodating projecting portions of a connector body, a connector body of molded flexible insulating material having an outer wall, a plurality of projecting portions on the surface of said outer wall for engaging and fitting into the recessed portions of the connector cavity inner wall, a plurality of collars integral with the end wall, extending therefrom and each collar having an opening therein for accommodating and fixedly holding an electrical terminal, and a resilient seal member disposed adjacent the end wall of the connector, having a plurality of holes corresponding to the number of terminals mounted in said collars for sealingly engaging said terminals and adapted to bear against a chamfered bearing portion of the cavity and thereby act upon said connector body in order to seal the end wall of the body from the cavity and resiliently urge said projecting portions into the recessed portions of the cavity.

7. The invention of claim 6 wherein said terminals comprise a solid, elongated body having a crimpable portion projecting through the openings in the resilient seal for crimping said terminal to an electrical wire and thereby providing a continuous, solid, seal surface adjacent said end wall.

8. The invention of claim 6 wherein the end wall comprises four collars for fixedly holding and supporting four electrical terminals and the resilient seal comprises a number of openings corresponding to a desired number of conductors up to and including four conductors.

9. The electrical connector of claim 6 further comprising a plurality of elongated tab portions, integral with said outer wall aligned with said projecting portions and long enough to extend beyond said cavity when said projecting portions are fitted into said recessed portions whereby said electrical connector is removable from its cavity by manipulating the elongated tabs to move toward each other, thereby withdrawing said aligned projecting portions from said recessed portions of the cavity.

* * * * *